United States Patent [19]

Baba et al.

[11] Patent Number: 4,931,222

[45] Date of Patent: Jun. 5, 1990

[54] PROCESS FOR TREATING RADIOACTIVE LIQUID WASTE CONTAINING SODIUM BORATE AND SOLIDIFIED RADIOACTIVE WASTE

[75] Inventors: Tsutomu Baba, Katsuta; Fumio Kawamura, Hitachi; Koichi Chino, Hitachi; Kiroyuki Tsuchiya, Hitachi; Makoto Kikuchi, Hitachi; Shin Tamata, Hitachi, all of Japan

[73] Assignee: Hitachi, Ltd., Tokyo, Japan

[21] Appl. No.: 384,888

[22] Filed: Jul. 24, 1989

Related U.S. Application Data

[63] Continuation of Ser. No. 81,224, Aug. 4, 1987, abandoned.

[30] Foreign Application Priority Data

Aug. 13, 1986 [JP] Japan ..... 62-188501

[51] Int. Cl.[5] ..... G21F 9/16; G21F 9/08; G21F 9/12; G21F 9/14

[52] U.S. Cl. ..... 252/628; 159/47.3; 159/DIG. 12; 159/23; 159/49; 252/631; 252/632; 252/633

[58] Field of Search ..... 159/DIG. 12, 47.3, 23, 159/49, 5, 6.1; 110/237, 238; 252/628, 631, 632, 633

[56] References Cited

U.S. PATENT DOCUMENTS

| | | | |
|---|---|---|---|
| 4,361,505 | 11/1982 | Kikuchi et al. | 252/632 |
| 4,383,888 | 5/1983 | Chino et al. | 252/632 |
| 4,409,137 | 10/1983 | Mergan et al. | 252/632 |
| 4,444,680 | 4/1984 | Kitzes et al. | 252/632 |
| 4,452,635 | 6/1984 | Noshi | 106/74 |
| 4,569,787 | 2/1986 | Horiuchi et al. | 252/632 |
| 4,632,779 | 12/1986 | Mizuno et al. | 252/633 |
| 4,648,990 | 3/1987 | Uetake et al. | 252/628 |
| 4,671,897 | 6/1987 | Mori et al. | 252/628 |
| 4,710,318 | 12/1987 | Horiuchi et al. | 252/628 |

FOREIGN PATENT DOCUMENTS

| | | | |
|---|---|---|---|
| 0120299 | 6/1985 | Japan | 252/632 |
| 1008699 | 1/1986 | Japan | 252/632 |

*Primary Examiner*—Howard J. Locker

*Attorney, Agent, or Firm*—Fay, Sharpe, Beall, Fagan, Minnich & McKee

[57] ABSTRACT

The present invention provides drying and pulverization of a radioactive liquid waste containing sodium borate as a main component by heating, where the liquid waste is heated, dried and pulverized to substantially crystalline, homogeneous powder of sodium borate while suppressing occurrence of a foaming phenomenon of the powder. The susbtantially crystalline powder is obtained by heating, drying and pulverizing the liquid waste at a temperature outside the temperature range where the salt powder takes an amorphous state in the course of releasing water of crystallization from the salt powder. In the drying and pulverization of a liquid waste containing sodium borate by a thin film evaporator, occurrence of the foaming phenomenon can be suppressed by maintaining the temperature on the heat transfer surface of the evaporator at a temperature lower than 150° C.

14 Claims, 9 Drawing Sheets

PROCESS FOR TREATING RADIOACTIVE LIQUID WASTE CONTAINING SODIUM BORATE AND SOLIDIFIED RADIOACTIVE WASTE

This is a continuation of co-pending application Ser. No. 081,224, filed on Aug. 4, 1987, now abandoned.

BACKGROUND OF THE INVENTION

This invention relates to treatment of a radioactive waste, and more particularly to a process for treating a radioactive waste, which is suitable for converting a concentrated liquid waste, particularly a concentrated liquid waste containing sodium borate as a main component, as produced from an atomic power plant based on a pressurized water reactor (PWR) to homogeneous powder.

Liquid wastes containing radioactive substances (sodium sulfate as a main component), as produced from an atomic power plant based on a boiling water reactor (BWR) have been so far dried and pulverized by a thin film evaporator to attain a large volume reduction, as disclosed in Japanese Patent Application Kokai (Laid-open) No. 54-29878, Japanese Patent Application Kokai (Laid-open) No. 61-28897, etc. Heating of the liquid wastes in the centrifugal film drier has been usually carried out by introducing superheated steam at about 170° C. into a jacket provided on the outside shell surface of the thin film evaporator from a boiler in the atomic power plant.

The present inventors have tried to dry and pulverize a concentrated liquid waste containing sodium borate as a main component as produced from the PWR power plant by a thin film evaporator, and have found that in the case of the liquid waste containing sodium borate as the main component there appears a foaming phenomenon during the step of drying and pulverization and no homogeneous powder can be obtained. The power that has experienced the foaming phenomenon cannot undergo successive pelletization with good success. Furthermore, when the powder that has experienced the foaming phenomenon is solidified, no homogeneous solidified mass of radioactive waste can be obtained.

SUMMARY OF THE INVENTION

An object of the present invention is to treat a liquid waste containing sodium borate as a main component by drying and pulverizing it to homogeneous powder while suppressing occurrence of a foaming phenomenon during the step of drying and pulverization.

The said object can be attained by converting the sodium borate contained as the main component in the liquid waste substantially to crystalline powder through the step of drying and pulverization.

To obtain crystalline powder, the heating and the drying and pulverization must be carried out at a temperature outside the temperature range where an amorphous state occurs in the course of dehydration of the salt, i.e. release of water of crystallization from the salt. When a liquid waste containing sodium borate as a main component is dried and pulverized in a thin film evaporator, occurrence of the foaming phenomenon can be suppressed by maintaining the heat transfer surface of the evaporator at a temperature lower than 150° C.

Sodium borate can take water of crystallization as decahydrate, pentahydrate, tetrahydrate, dihydrate and monohydrate. It is known that among these hydrates anhydrous salt, decahydrate, pentahydrate and tetrahydrate take a crystalline state, whereas dihydrate and monohydrate take an amorphous state. Furthermore, water of crystallization is released from the salt stagewise at specific temperatures when the salt is heated and the temperature range for occurrence of dihydrate and monohydrate showing the amorphous state is 140° to 250° C.

On the other hand, the present inventors have found through basic experiments that the foaming phenomenon occurs abruptly around 150° C. at which the conversion of the powdery salt to an amorphous state increases to an appreciable degree.

Thus, in the case of drying and pulverizing a liquid waste containing sodium borate as a main component, the foaming phenomenon can be suppressed by making crystalline powdery salt, and homogeneous powder can be obtained thereby. To obtain the crystalline powder, the heating and the drying and pulverization must be carried out at a temperature lower than 150° C. for the foregoing reasons. The resulting powdery salt is homogeneous because it is produced without any experience of the foaming phenomenon, and thus pelletizing operation, solidifying operation by a solidifying agent, etc. can be facilitated.

DESCRIPTION OF THE PREFERRED EMBODIMENTS

The principle of the present invention will be described in detail below, referring to FIGS. 4 to 9.

The physical properties of sodium borate ($Na_2B_4O_7$) as the main component in a radioactive liquid waste, which is to be treated according to the present invention, depends upon temperature, as will be explained below, referring to FIG. 4.

Figure 5:
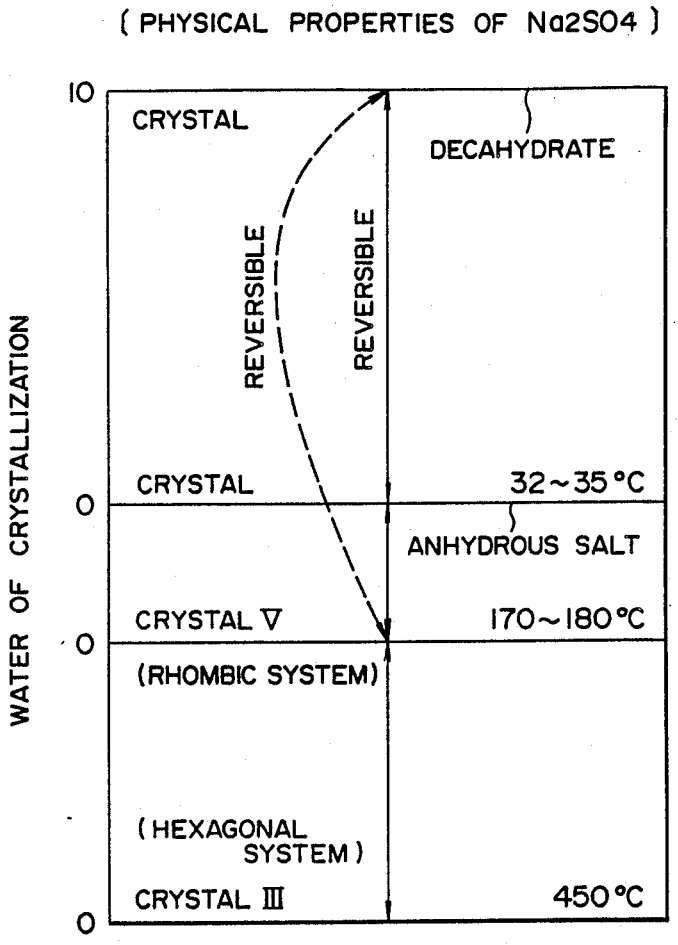
FIG. 5 is a diagram schematically showing physical properties of sodium sulfate.

$Na_2B_4O_7$ takes 6 kinds of state from the anhydrous salt state to the decahydrate state. The decahydrate is converted to pentahydrate and tetrahydrate at a temperature ranging from 70° to 130° C. Then, the pentahydrate and tetrahydrate are converted to dihydrate and monohydrate taking an amorphous state in a board temperature range of 140° to 250° C. Above 350° C., $Na_2B_4O_7$ exists as an anhydrous salt. On the other hand, it has been found through basic experiments that a foaming phenomenon occurs when the drying and pulverization temperature is elevated to 150° C. or higher, and the powder expands like a cage (see FIGS. 6 and 7). Thus, the present inventors have presumed that there is a correlation between the conversion to the amorphous state and the occurrence of the foaming phenomenon. To verify the presumption, the present inventors have investigated dependency of physical properties of sodium sulfate as the main component in a concentrated liquid waste from BWR, which has no experience of a foaming phenomenon at the same drying and pulverizing temperature, upon temperature. FIG. 5 shows the physical properties of sodium sulfate ($Na_2SO_4$).

$Na_2SO_4$ undergoes conversion from decahydrate to anhydrous crystal at a temperature ranging from 32° to 35° C., and then takes a rhombic system at 170° to 180° C. and a hexagonal system at 450° C. or higher without taking such an amorphous state as in the case of $Na_2B_4O_7$. This seems to be a reason for no occurrence of foaming when the liquid waste containing $Na_2SO_4$ is dried and pulverized. That is, it can be seen from the foregoing that the conversion of sodium borate to an amorphous state during the step of drying and pulverization is in a close relationship with the foaming phenomenon, and it is important in making sodium borate powder without foaming to evade the conversion to an amorphous state.

Figure 6:
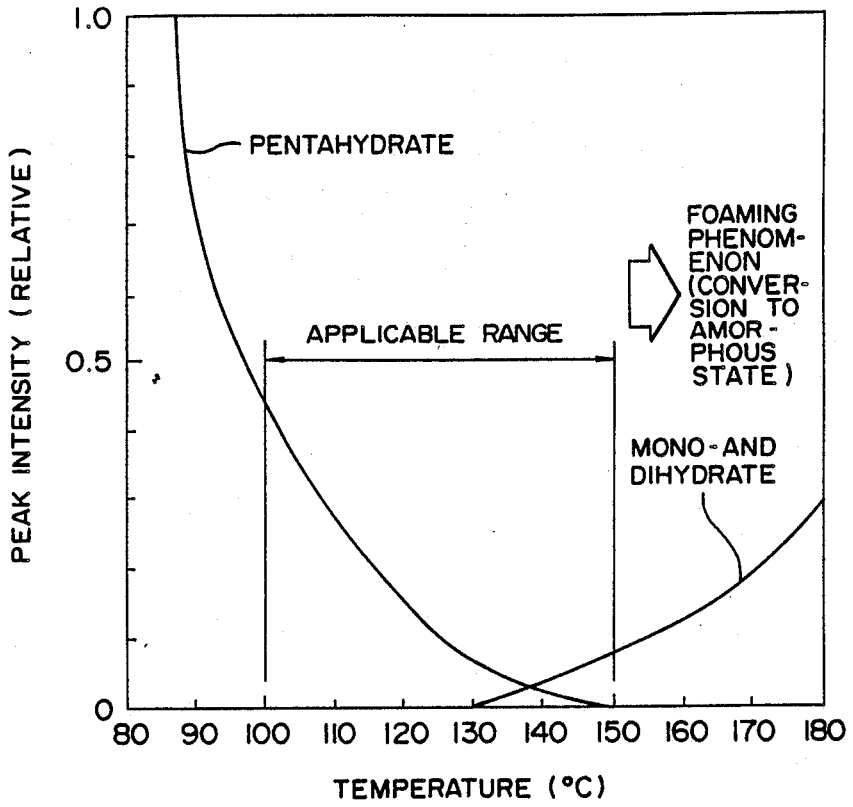
FIG. 6 is a diagram showing dependency of yields of sodium borate pentahydrate, monohydrate and dihydrate, as obtained from peak values of X-ray diffraction of the salts, upon temperature.

Then, the present inventors have investigated the drying and pulverizing temperature for making powder from a liquid waste containing sodium borate as the main component while suppressing occurrence of foaming phenomenon. The dependency upon temperature of the state of water of crystallization on sodium borate has been fully investigated by X-ray diffraction analysis. FIG. 6 shows the results of analysis, where changes in the peaks of pentahydrate, and monohydrate and dihydrate of $Na_2B_4O_7$, by heating temperature are shown. No peak of pentahydrate is observed at all at 150° C. or higher where occurrence of the foaming phenomenon is remarkable. On the other hand, such a tendency that monohydrate and dihydrate showing an amorphous state gradually increase is observed. Thus, it seems that a foaming phenomenon occurs when the conversion of the powder to an amorphous state proceeds to some extent. It can be seen from the foregoing that homogeneous powder can be obtained by controlling the drying and pulverizing temperature to lower than 150° C.

Figure 7:
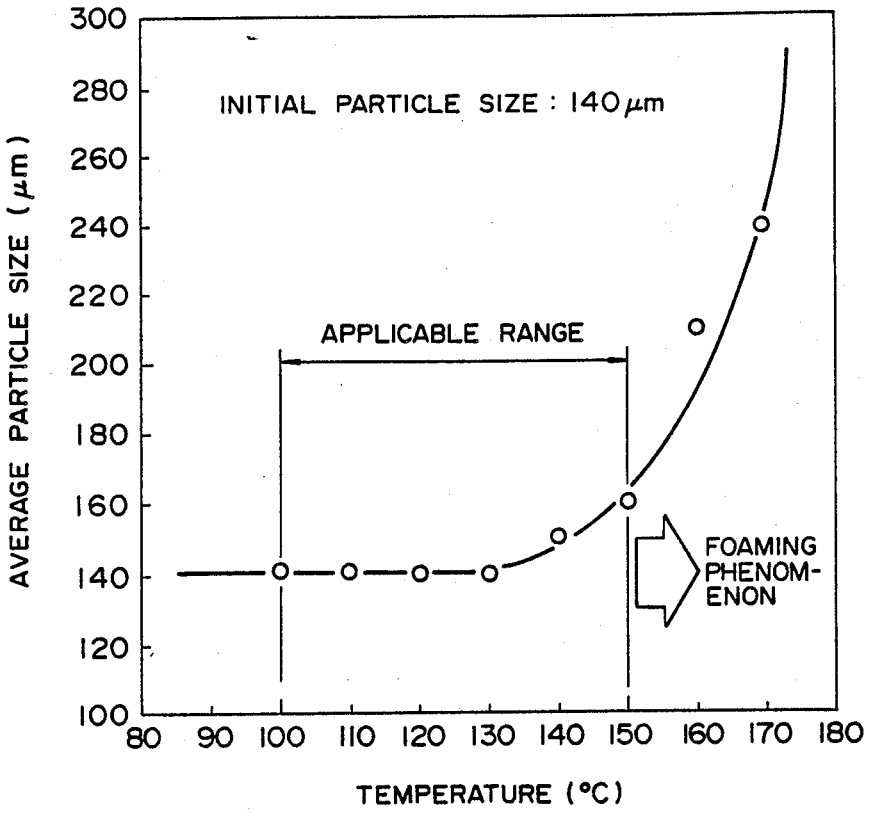
FIG. 7 is a diagram showing a relationship between the operating temperature of a thin film evaporator and the particle size of the resulting powder.

In FIG. 7, a relationship between the temperature and the average particle size of the resulting powder is specifically shown. The average particle of homogeneous powder is 140 to 160 μm, whereas, when the operating temperature of a thin film evaporator exceeds 150° C., the average particle size abruptly increases, and the foaming phenomenon starts to occur at the same time. It can be seen from this fact that the particle size starts to increase by the occurrence of foaming phenomenon. Once the foaming takes place, the resulting powder is hard to pelletize, or even if pelletized, the density of pellets cannot be made larger. It has been also found that the powder having an average particle size of 160 μm or more is composed of monohydrate and dihydrate.

Figure 8:
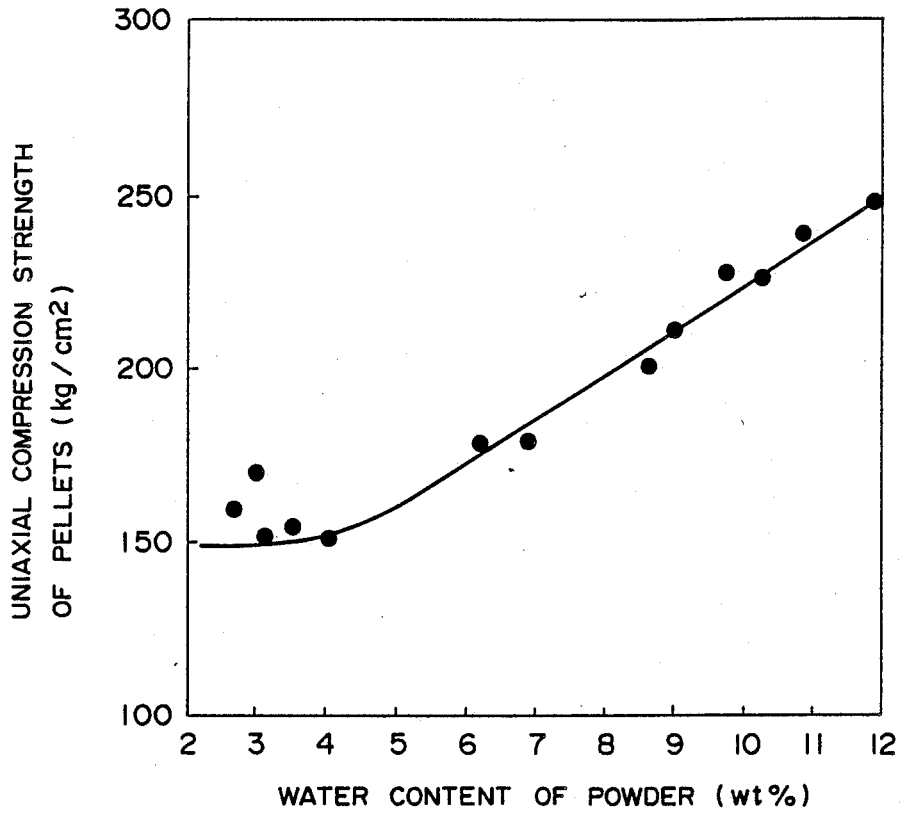
FIG. 8 is a diagram showing a relationship between the uniaxial compression strength of pellets formed in the step of pelletizing and the water content of the powder to be fed to a pelletizer.

Then, the present inventors have investigated a relationship between the water content of powder formed by a thin film evaporator and the strength of pellets formed by a pelletizer. As shown in FIG. 8, the higher the water content, the higher the strength of pellets. The powder obtained when the thin film evaporator is operated at 100° to 150° C. has a water content of about 10%. It can be seen from the foregoing that the powder formed at a temperature lower than 150° C. is effective for pelletization as one of the successive steps without any trouble. In the solidification of the powder, homogeneous powder can be also made into more satisfactory solidified mass.

Figure 9:
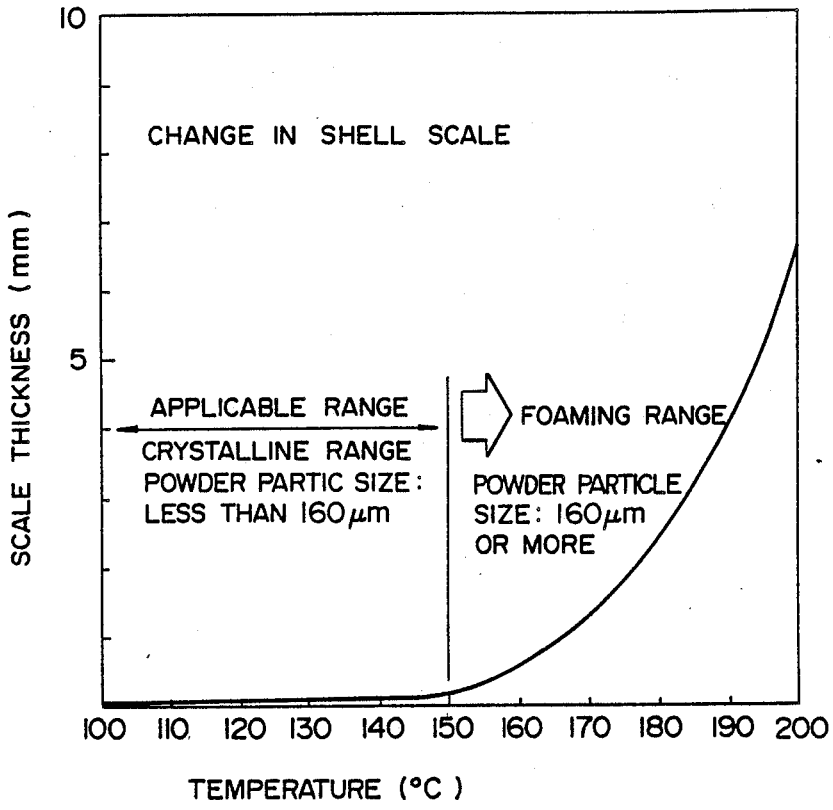
FIG. 9 is a diagram showing a relationship between the operating temperature of a thin film evaporator and the thickness of scales deposited on the shell inside wall of the thin film evaporator when a liquid waste containing sodium borate as a main component is treated.

Then, through basic experiments the present inventors have investigated the state of scale formation on the heat transfer surface (shell inside wall) of a thin film evaporator when a liquid waste containing sodium borate as the main component is dried and pulverized. The results are shown in FIG. 9. It can be seen from FIG. 9 that no scales are deposited on the shell inside wall at a temperature lower than 150° C., that is, before the foaming phenomenon occurs. This is due to the adhesiveness of the amorphous powder. Deposition of scales largely lowers the reliability of a thin film evaporator when continuously operated for a long period of time.

On the basis of various data from the basic experiments as described above, the present inventors have found that it is necessary to dry and pulverize a liquid waste containing sodium borate as the main component at a temperature lower than 150° C. in a thin film evaporator.

Generally, a thin film evaporator is operated under a weakly subatmospheric pressure (weakly negative pressure) near the atmospheric pressure, and thus it is necessary to operate the evaporator at a temperature higher than 100° C. to conduct the drying and pulverization with heating. If the drier is operated under more highly subatmospheric pressure, the evaporator can be operated at a temperature lower than 100° C. In this case, decahydrate powder may be obtained, as is obvious from FIG. 4. Powder having much water of crystallization means that the powder contains water correspondingly, and ultimately the volume of the powder to be filled in a container such as drum, etc. for storing the radioactive waste is reduced. That is, much water of crystallization on the powder is not preferred. In view of the water content of powder, it is preferable to operate the evaporator at 140° to 150° C.

Figure 1:
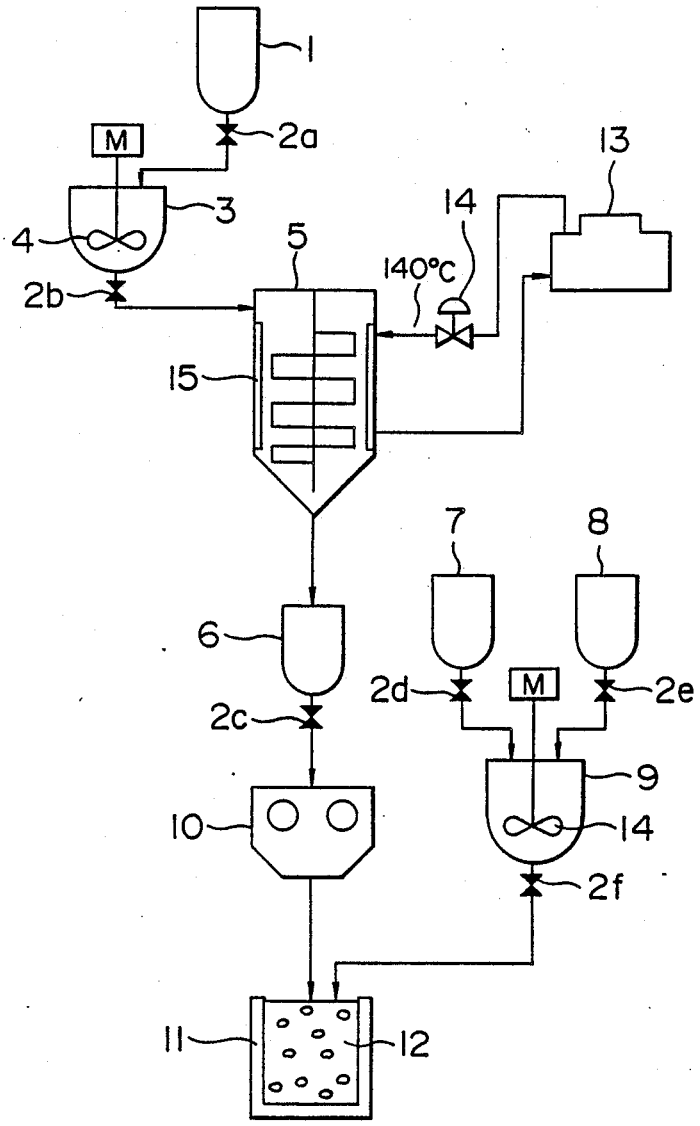
FIGS. 1, 2 and 3 are flow diagrams of apparatuses for treating a radioactive liquid waste according to the present invention.
Figure 2:
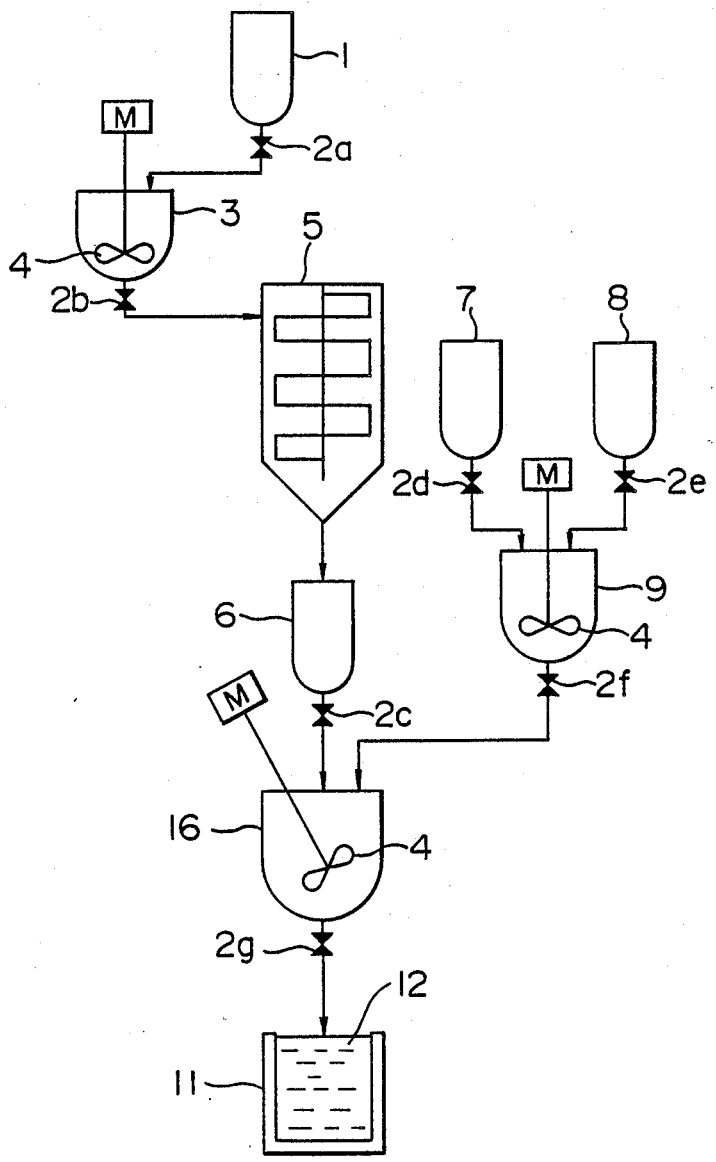
Figure 3:
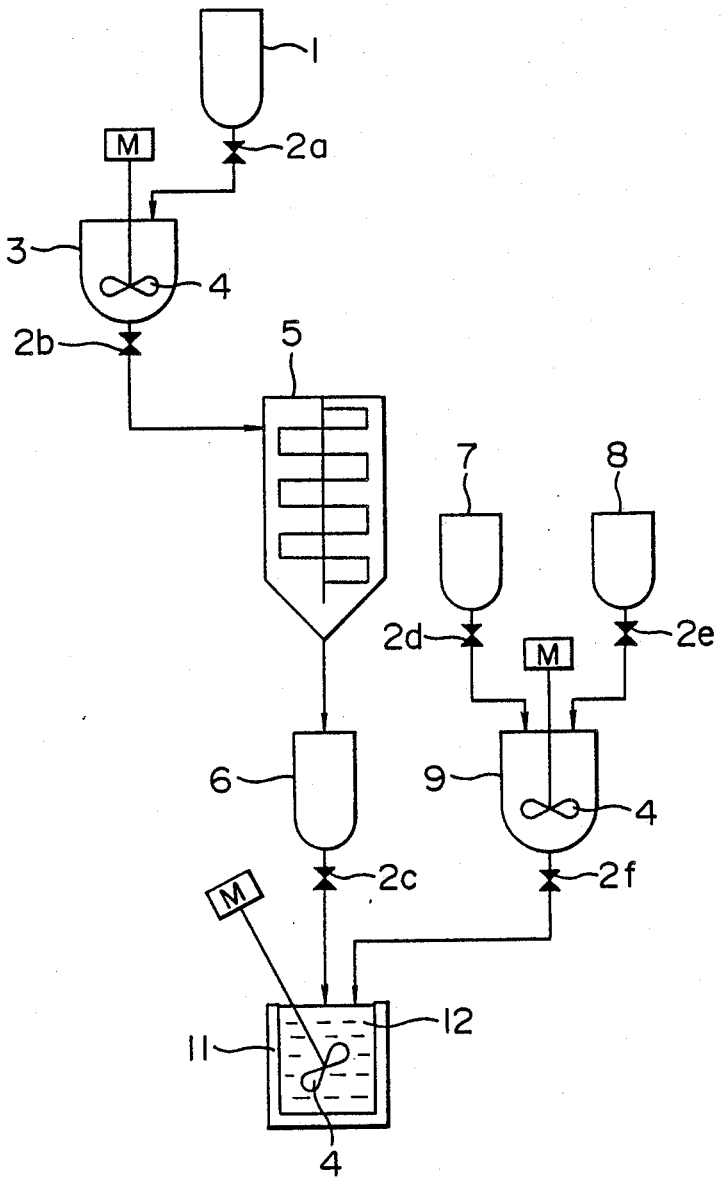

Embodiments of drying and pulverizing a radioactive liquid waste containing sodium borate as a main component in a thin film evaporator and solidifying the resulting powder together with a solidifying agent in a solidifying container according to the present invention will be described in detail below, referring to FIGS. 1 to 3.

EXAMPLE 1

A concentrated radioactive liquid waste containing sodium borate as a main component is charged from a storage tank 1 into a mixing tank 3 through a valve 2*a*. The mixing tank 3 is provided with rotating blades 4, which turn by a motor, to make uniform stirring. After uniform stirring without depositing precipitates, etc., the liquid waste is led to a thin film evaporator 5 through a valve 2*b*. The thin film evaporator 5 is provided with a jacket 15 on the shell outside of the evaporator and is so controlled that the temperature on the heat transfer surface for drying and pulverization can be at a temperature lower than 150° C. by supplying superheated steam into the jacket 15 from a boiler 13 through a pressure-reducing valve 14. The number of revolution of blades in the evaporator is designed to be kept as desired for the drying and pulverization. That is, superheated steam at about 170° C. is usually used for the temperature control of the thin film evaporator 5, and the pressure of superheated steam is controlled by the pressure-reducing valve 14 before the superheated steam is introduced into the jacket 15 so as to make the temperature of superheated steam lower than 150° C. In the present embodiment, superheated steam controlled to about 140° C. is supplied to the jacket 15. The radioactive liquid waste is charged into the evaporator at the upper part, and brought into a slurry state and finally dried and pulverized while going down through the shell. Since the thin film evaporator 5 is operated at a temperature lower than 150° C., homogeneous powder can be obtained without any experience of a foaming phenomenon. The thus obtained powder is provisionally stored in a storage tank 6, then led to a pelletizer 10 through a valve 2*c* and pelletized. The pelletized sodium borate is led to a solidifying container 11 directly or after provisional storage in another tank or storing facility, and solidified. A solidifying agent is separately led to the solidifying container 11. In the present embodiment, an inorganic solidifying agent is used. The inorganic solidifying agent is stored in a tank 7 and led to a mixing tank 9 through a valve 2*d*. On the other hand, a hardening agent and water are led to the mixing tank 9 from a tank 8 through a valve 2*e*. The mixing tank 9 is provided with rotating blades 14 which turn by a motor, and the solidifying agent can be mixed into a homogeneous state with a desired viscosity. The homogeneous solidifying agent with the desired viscosity is led to the solidifying container 11 filled with the pellets from the mixing tank 9 through a valve 2*f*. A solidifier mass 12 of pellets among which the solidifying agent is filled can be obtained. The inorganic solidifying agent is preferably cement or water glass or cement glass, but plastics or asphalt may be used as the solidifying agent. The highly satisfactory, solidified mass 12 can be produced from any of the solidifying agents in the present embodiment.

Figure 4:
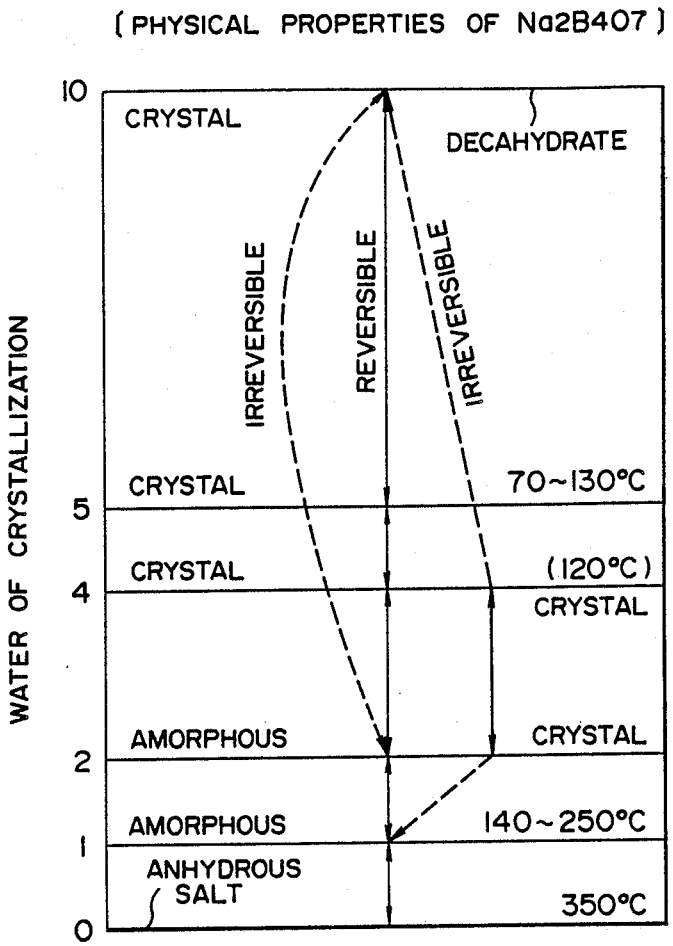
FIG. 4 is a diagram schematically showing physical properties of sodium borate.

Just after discharge from the thin film evaporator, the powder is substantially in a pentahydrate state, but between the provisional storage tank 6 and the solidifying container 11, the powder comes to partially contain decahydrate, as is obvious from FIG. 4.

EXAMPLE 2

Another embodiment of homogeneous solidification according to the present invention will be described, referring to FIG. 2.

A concentrated liquid waste containing sodium borate as a main component is led to a mixing tank 3 from a storage tank 1 through a valve 2*a*. The mixing tank 3 is provided with rotating blades 4 which turn by a motor to conduct uniform stirring without depositing precipitates. When the concentration of the concentrated liquid waste is so low that deposition of precipitates may cause no problem, the liquid waste can be led directly to a thin film evaporator 5 without passing through the mixing tank 3. The sodium borate liquid waste uniformly stirred in the mixing tank 3 is led to the thin film evaporator 5 through a valve 2*b*. The thin film evaporator 5 is so controlled that the heat transfer surface for drying and pulverization can be lower than 150° C. The temperature control is carried out with superheated steam whose once elevated temperature has been made lower by pressure control through a pressure-reducing valve in the same manner as in Example 1 (not shown in FIG. 2). The thin film evaporator 5 is so controlled that its blades can rotate at a desired number of revolution per minute at a temperature lower than 150° C. to conduct the satisfactory drying and pulverization. Under these operating conditions, homogeneous powder can be formed in the thin film evaporator 5 without any experience of a foaming phenomenon. The thus obtained powder is led to a provisional storage tank 6 and then supplied to the next step. That is, a desired amount of the powder is led to a mixing tank 16 from the storage tank 6 through a valve 2*c*. The mixing tank 16 is provided with rotating blades 4 which turn by a motor to conduct uniform stirring in the tank, where the sodium borate powder as the waste is mixed with a solidifying agent.

Any of inorganic solidifying agents, plastics and asphalt can be used as the solidifying agent. In this embodiment, a case of using an inorganic solidifying agent is exemplified. The inorganic solidifying agent (cement, water glass or cement glass) is supplied into a solidifying agent mixing tank 9 from a tank 7 through a valve 2*d*. The solidifying agent mixing tank 9 is provided with rotating blades 4 which turn by a motor to conduct uniform mixing. On the other hand, a solidification additive (a hardening agent or water, or a mixture of a hardening agent and water) is supplied to the solidifying agent mixing tank 9 from a tank 8 through a valve 2*e*, and mixed together with the solidifying agent until a uniform mixture with a desired viscosity can be obtained. Then, the mixture containing the solidifying agent is supplied to the mixing tank 16 previously filled with the sodium borate powder through a valve 2*f* and mixed with the powder until a uniform mixture is obtained. Then, the uniform mixture is led to a solidifying container from the mixing tank 16 through a valve 2*g* to produce a homogeneous solidified mass 12. The thus produced homogeneous solidified mass 12 is highly satisfactory whenever produced with any of the solidifying agents. The foregoing embodiment is an example of homogeneous solidification according to an outdrum system.

EXAMPLE 3

An embodiment according to an in-drum system will be described below, referring to FIG. 3.

The present embodiment is characterized by supplying the powder directly into the solidifying container 11 from the tank 6 in Example 2. A desired amount of the powder provisionally stored in the tank 6 is supplied into the solidifying container 11 through the valve 2*c*. In the solidifying container 11, rotating blades 4 which are detachable by pulling them in a vertical direction and turn by a motor are placed, and are removed after the solidifying agent has been homogeneously mixed with the powder. The powder led to the solidifying container 11 is mixed with the solidifying agent therein. Any of inorganic solidifying agents, plastics and asphalt can be used as the solidifying agent, but in the present embodiment, a case of using an inorganic solidifying agent is exemplified. An inorganic solidifying agent (cement, water glass or cement glass) is introduced into a solidifying agent mixing tank 9 from a tank 7 through a valve 2*d*. The solidifying agent mixing tank 9 is provided with rotating blades 4 which turn by a motor to conduct uniform mixing. On the other hand, a solidification additive (a hardening agent or water or a mixture of a hardening agent and water) is led to the solidifying agent mixing tank 9 from a tank 8 through a valve 2*e* and mixed with the solidifying agent until a uniform mixture with a desired viscosity can be obtained.

Then, the mixture containing the solidifying agent is led to the solidifying container provided with the detachable rotating blades 4 through a valve 2*f* and homogeneously mixed with the powder to produce a homogeneous solidified mass 12. When it is possible to supply the solidifying agent and the solidification additive directly into the solidifying container to conduct mixing with the powder, the solidifying agent mixing tank 9 can be omitted. The thus produced homogeneous solidified mass 12 is highly satisfactory, whenever prepared with any of the solidifying agents in the present embodiment.

In the foregoing embodiments, the operating temperature of the thin film evaporator is controlled with superheated steam at about 170° C. now used in atomic power plants, and thus the temperature is made lower than 150° C. by providing a pressure-reducing valve at the steam inlet to the evaporator. When a boiler proper to the thin film evaporator is provided, it is possible to feed the steam directly to the evaporator from the boiler without using any pressure-reducing valve.

Furthermore, when a proper boiler is provided to set the operating temperature of the evaporator at 350° C. or higher, homogeneous anhydrous sodium borate salt powder can be produced.

According to the present invention, occurrence of a foaming phenomenon can be suppressed during the step of drying and pulverizing a liquid waste containing sodium borate as a main component by evading the conversion of sodium borate to an amorphous state, and thus homogeneous powder can be produced. This is effective for facilitating pelletizing or solidification as a successive step.

What is claimed is:

1. A process for treating radioactive liquid waste comprising the steps of:

(a) providing a radioactive liquid waste containing sodium borate as the main component;

(b) charging a thin film evaporator with the radioactive liquid waste containing sodium borate as the main component;

(c) heating the thin film evaporator to a temperature lower than 150° C. thereby drying and pulverizing the liquid waste containing sodium borate into powdered waste form; and, (d) packing the powdered sodium borate waste in a container with an inorganic solidifying agent to solidify the resulting mixture therein.

2. A process for producing a homogeneous powder from radioactive liquid waste containing sodium borate comprising the steps of:

(a) providing a radioactive liquid waste containing sodium borate as the main component;

(b) charging a thin film evaporator with the radioactive liquid waste containing sodium borate as the main component; and, (c) heating the thin film evaporator to a temperature lower than 150° C. thereby drying and pulverizing the liquid waste containing sodium borate into a homogeneous powdered waste form.

3. The process of claim 2, wherein the thin film evaporator is heated to a temperature greater than 100° C.

4. A process for producing a homogeneous powder from radioactive liquid waste containing sodium borate comprising the steps of:

(a) providing a radioactive liquid waste containing sodium borate as the main component;

(b) charging a thin film evaporator with the radioactive liquid waste containing sodium borate as the main component;

(c) heating the thin film evaporator to a temperature lower than 150° C. thereby drying and pulverizing the liquid waste containing sodium borate into a homogeneous powdered waste form; and, (d) packing the powdered sodium borate waste in a container with an inorganic solidifying agent to solidify the resulting mixture therein.

5. The process of claim 4, wherein the thin film evaporator is heated to a temperature greater than 100° C.

6. The process of claim 4, wherein before packing, the powdered sodium borate waste is formed into pellets.

7. The process of claim 4, wherein the solidifying agent is selected from the group consisting of cement, water glass, cement glass, plastics, and asphalt.

8. The process of claim 4, further comprising the step of mixing the powdered sodium borate waste with the inorganic solidifying agent prior to solidification to form a substantially homogeneous mixture.

9. A process for treating radioactive liquid waste comprising the steps of:

(a) providing a radioactive liquid waste containing sodium borate as the main component;

(b) charging a thin film evaporator having a heat transfer surface and rotor means for contacting said heat transfer surface with the radioactive liquid waste containing sodium borate as the main component;

(c) heating the heat transfer surface on the thin film evaporator to a temperature lower than 150° C. thereby drying the liquid waste containing sodium borate into a solid sodium borate waste residue;

(d) rotating said rotor means thereby pulverizing the solid sodium borate waste residue into powdered form; and, (e) packing the powdered sodium borate waste residue in a container with an inorganic solidifying agent to solidify the resulting mixture therein.

10. The process of claim 9, wherein the heat transfer surface on the thin film evaporator is heated to a temperature greater than 100° C.

11. The process of claim 9, wherein after pulverizing and before packing, the powdered sodium borate waste residue is formed into pellets.

12. The process of claim 9, wherein the solidifying agent is selected from the group consisting of cement, water glass, cement glass, plastics and asphalt.

13. The process of claim 9, further comprising the step of mixing the powdered sodium borate waste with the inorganic solidifying agent prior to solidification to form a substantially homogeneous mixture.

14. The process of claim 9, wherein the heat transfer surface on the thin film evaporator is heated to a temperature above 100° C. and below 150° C. by superheated steam contained in a steam jacket surrounding the heat transfer surface.

* * * * *